United States Patent [19]

Wilson

[11] Patent Number: 4,804,089

[45] Date of Patent: Feb. 14, 1989

[54] WRAP-AROUND ARTICLE CARRIER WITH END FOLD-IN PANEL

[75] Inventor: Jerry F. Wilson, West Monroe, La.

[73] Assignee: Manville Corporation, Denver, Colo.

[21] Appl. No.: 130,031

[22] Filed: Dec. 7, 1987

[51] Int. Cl.[4] ..... B65D 65/12; B65D 75/14

[52] U.S. Cl. ..... 206/435; 206/140; 206/147; 206/155; 206/161; 229/40

[58] Field of Search ..... 206/427, 434, 435, 140, 206/155, 161, 139, 145, 147, 141; 229/40, 52 BC

[56] References Cited

U.S. PATENT DOCUMENTS

| | | | |
|---|---|---|---|
| 3,128,010 | 4/1964 | Fomer | 229/40 |
| 3,294,280 | 12/1966 | Graser | 206/155 |
| 3,398,856 | 8/1968 | Graser | 229/40 |
| 3,410,397 | 11/1968 | Cato | 206/155 X |
| 3,429,496 | 2/1969 | Hickson | 206/155 X |
| 3,478,951 | 11/1969 | Graser | 206/140 X |
| 3,977,518 | 8/1976 | Anneson | 206/434 X |
| 4,328,893 | 5/1982 | Oliff et al. | 206/140 X |

*Primary Examiner*—Stephen Marcus
*Assistant Examiner*—Bryon Gehman
*Attorney, Agent, or Firm*—John D. Lister

[57] ABSTRACT

A paperboard wrap-around article carrier which has end panels foldably connected to the top panel and to gusset panels. The gusset panels allow the end panels to be folded and maintained in a substantially vertical position. The end panels extend beyond the lowermost ends of the gusset panels so that the foldable connections between the gusset panels and the end panels is minimal, thus minimizing the cumulative memory of the fibers in the foldable connections to prevent the forces generated by the memory from unfolding the end panels and snapping them up out of place.

9 Claims, 2 Drawing Sheets

WRAP-AROUND ARTICLE CARRIER WITH END FOLD-IN PANEL

FIELD OF THE INVENTION

This invention relates to wrap-around article carriers which have end panels that are unattached to the bottom panel. More particularly, it relates to a wrap-around article carrier of this type in which the end panel is easily folded into place.

BACKGROUND OF THE INVENTION

Wrap-around beverage container carriers are available in many different styles and designs, some of which incorporate end panels. One such type includes a very short end panel foldably connected along its upper edge to the top panel of the carrier. Gusset panels foldably connected to the end and side panels of the carrier allow the end panels to be folded down to a generally vertical position, the inward folding of the gusset panels holding the end panel in its vertical position. Examples of such an arrangement can be found in U.S. Pat. Nos. 3,963,121 to Kipp and in 4,029,204 to Manizza.

Although the short end panel in such carriers can be provided at a relatively small added cost, and although it provides such benefits as assisting to hold the end bottles in the carrier in place and functioning to a limited extent as an advertising display panel, it has some disadvantages. The area available for display purpose is too small for most advertising messages and the end panels are too short to provide other desired functions. Longer panels, for example, can extend down far enough to cover the labels on bottles and protect them from being scuffed or otherwise damaged during passage of the bottles through the packing machine and during subsequent handling. This is important not only for the sake of appearance but also to protect the UPC label so that automatic price reading equipment used at check-out counters does not give erroneous readings. Longer end panels also shield the contents of glass bottles or jars from the sun, which in the case of certain products, such as baby food, is important.

Fully enclosed carriers, of course, provide these functions but are quite expensive. In order to provide these benefits at a minimum of expense, end panels have been used which extend down toward the bottom panel a substantial distance but are not connected to the bottom panel of the carrier, thus reducing the amount of paperboard required for each carrier blank. End panels of this type are normally foldably connected to gusset panels or tuck flaps which themselves are foldably connected to the top and side panels of the carrier. This arrangement requires that the carrier be designed so as to prevent the end panels from unfolding and springing out from their generally vertical position. A variety of arrangements have been suggested to accomplish this, usually employing some form of locking means interacting with the containers in the carrier, one example of which is disclosed in U.S. Pat. No. 3,398,856, issued on Aug. 27, 1968 to Graser.

It would be desirable to be able to use warp-around carriers employing end panels which are long enough to provide all the benefits enumerated above and yet which are even more economical than the end panel carriers heretofore available.

BRIEF SUMMARY OF THE INVENTION

This invention provides a paperboard carrier incorporating end panels foldably connected to the top panel. Gusset panels are connected by first fold lines to the side panels of the carrier near the fold lines connecting the side panels to the top panel. The gusset panels are also connected by second fold lines to the end panels near the fold lines connecting the end panels to the top panel. The lowermost ends of the second fold lines terminate a substantial distance from the bottom edge of the end panels and are connected by the lower edges of the gusset panels to the side edges of the end panels. Because the second fold lines are relatively short compared to the length of the end panels, the cumulative memory of the fibers in the second fold lines is less than that requried to overcome the forces holding the end panels in closed, substantially vertical position.

This arrangement not only provides end panels which provide the desirable benefits mentioned above at a low cost as a result of economical use of paperboard, the packaging operation itself is simplified due to the single folding step required to move the end panel into place.

Other features and aspects of the invention, as well as its various benefits, will become more clear in the detailed description of the preferred embodiment which follows.

DESCRIPTION OF THE PREFERRED EMBODIMENT

Figure 1:
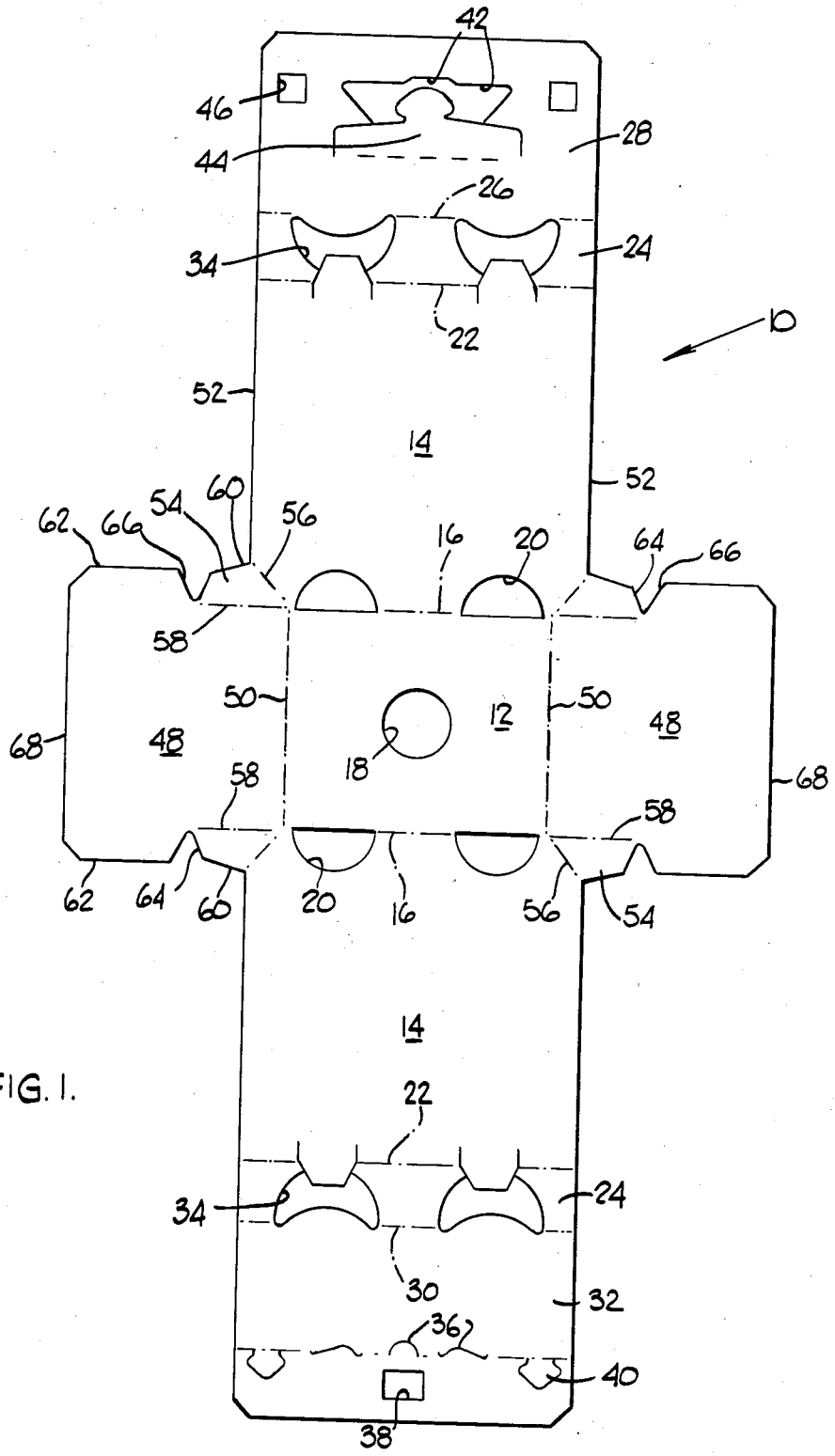
FIG. 1 is a plan view of a production blank used in forming the carrier of the present invention.

Referring to FIG. 1, a carrier blank 10 is comprised of a top panel section 12 foldably connected to side panel sections 14 along score lines 16. The top panel section may be provided with a suitable handle, which for purpose of illustration is shown as a finger hole 18. The side panel sections are also provided with cutouts 20 adjacent the score lines 16 for receiving the tops or bottle caps of containers packaged in the carrier. Althoguh in this case the blank is shown as being designed to form a carrier for holding four containers, the invention is not limited to use in a four-pack carrier.

Both sides panel sections are connected by score lines 22 to short sloped side panel sections 24, one of which is connected by score line 26 to an outer bottom panel section 28 and the other of which is connected by score line 30 to an inner bottom panel section 32. Cutouts 34 in the sloped sections 24 allow the heel portions of containers packaged in a carrier formed from the blank to extend therethrough to assist in holding the containers in place. The inner bottom panel section 32 is illustrated as having alternate primary male locking tabs 36, a secondary locking aperture 38 and tertiary locking tabs 40. The outer bottom panel section 28 is illustrated as having alternate primary locking edges 42, a secondary male locking tab 44 and tertiary female locking apertures 46. These locking components do not form a part of the present invention but are used to lock the bottom panel sections together to form the bottom panel of a carrier in a manner understood in the industry. For a more complete description of related locking components and their functions, attention is directed to U.S. Pat. No. 4,437,606, issued Mar. 20, 1984 to Graser.

Still referring to FIG. 1, the end edges of the top panel section 12 are connected to end panels 48 along fold lines 50 which are offset in an inward direction from the end edges 52 of the side panel sections 14. Gusset panels or tuck flaps 54 are connected to side panel sections 14 along fold lines 56 which extend from the edges 52 of the side panel sections to the ends of the fold lines 50. The fold lines 56 are thus at an angle to both the edges 52 and the fold lines 50. The gusset panels are also connected along fold lines 58 to the end panels 48, the fold lines 58 being an extension of the fold lines 16.

The distance between the side edges 60 of a pair of gusset panels is approximately equal to the distance between the side edges 62 of an end panel 48, which is substantially equal to the distance between the side panels of a fully loaded carrier. Each gusset panel in the blank has an outermost edge 64 which connects side edge 60 of the gusset panel to the outermost end of the associated fold line 58, the outermost edge of the gusset panel and the outermost end of the fold line 58 corresponding to the lowermost edge and lowermost end, respectively, of these elements in a carrier formed from the blank. As a result of this arrangement the end panels include edges 66 which connect the end panel edges 62 to the point at which the fold line 58 and the gusset panel edges 64 intersect. Preferably, for ease of fabrication, the edges 66 are spaced from the gusset panel edges 64 as shown. The bottom edge 68 of the end panels 48 is located a substantial distance from the end of fold lines 58 so as to permit the end panels to cover substantial portions of the containers or other articles in the carrier.

Figure 2:
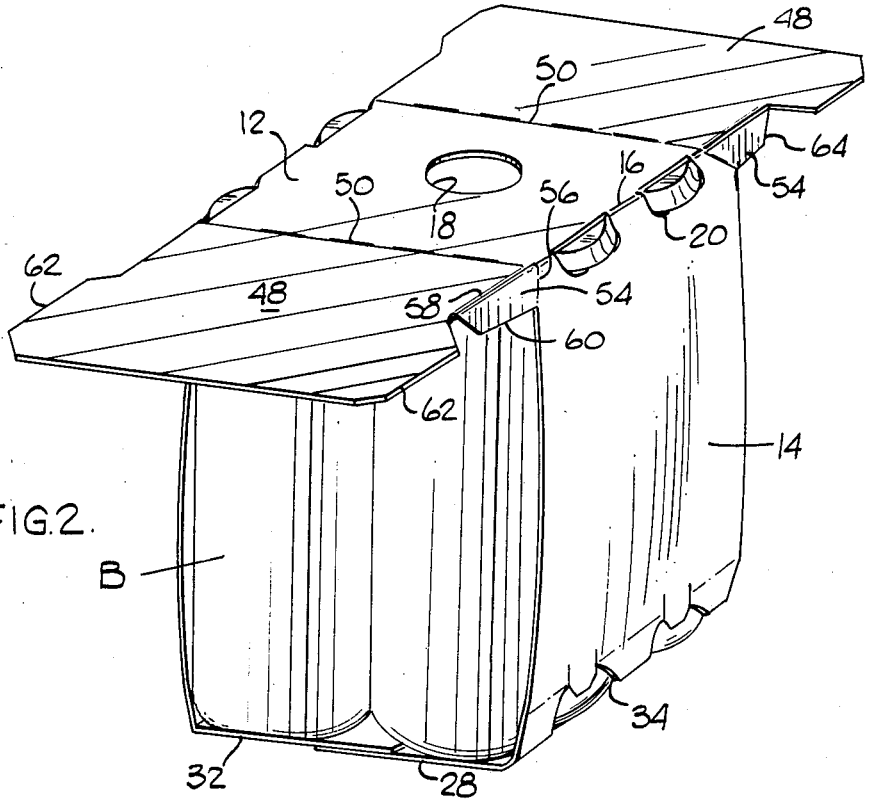
FIG. 2 is a pictorial view of the carrier of the present invention in an intermediate stage of formation resulting from wrapping the blank of FIG. 1 around four bottles and securing the bottom panels together.

In practice, the blanks 10 are supplied to an automatic packaging machine which wraps the blanks around the beverage containers and secures the bottom panel sections together to form the intermediate form of carrier shown in FIG. 2. As illustrated, the end panels 48 extend outwardly from the top panel 12 and the gusset panels 54 are folded down about fold lines 58 as a result of the initial folding process. The gusset panels at this point remain basically unfolded along fold lines 56. The bottles B are securely held in the carrier by a combination of pressures, snugly fitting between the side panels 14 and partially extending through the heel cutouts 34. The caps of the bottles partially extend through the cap cutouts 20 to further assist in holding the bottles in place.

Figure 3:
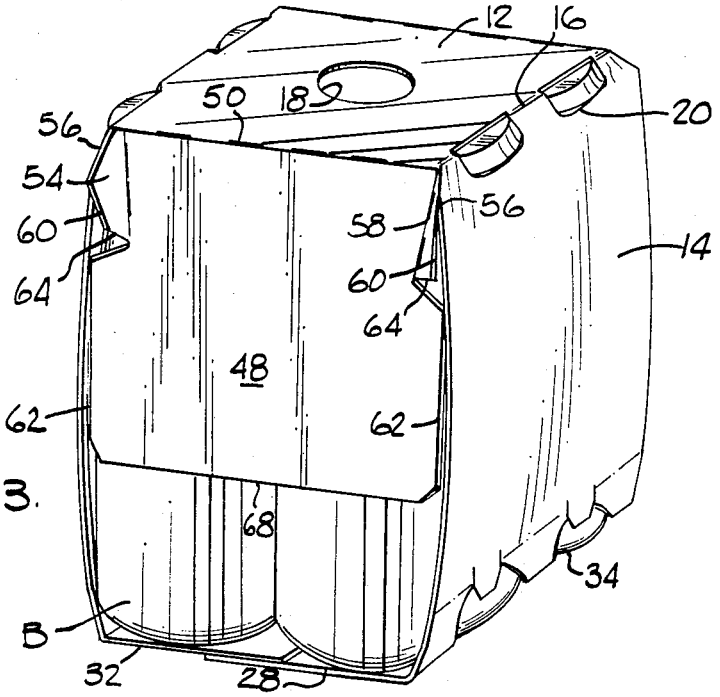
FIG. 3 is a pictorial view of a fully formed carrier fabricated from the blank of FIG. 1.

Inward pressure applied by a packaging machine element (not shown) against the end flaps 48 causes the end flaps to fold inwardly about score lines 50 and the gusset panels 54 to fold downwardly about fold lines 56. The resulting downward movement of the end panels 48 and the gusset panels 54 causes the end panels and connect gusset panels to have relative upward folding movement about fold lines 58, allowing the gusset panels to fold down about fold lines 56 until the end panels reach their final position shown in FIG. 3. As shown, the end panels can be made to extend down far enough to cover the significant portions of the containers or bottles B and can be made wide enough to extend substantially fully across the end opening between the side panels 14.

The intersection of fold lines 58 and gusset panel edges 64 is located a relatively short distance from the top panel 12 compared to the length of the end panels. By this arrangement fold lines 58 are long enough to hold the end panels in their desired positions adjacent the end edges of the side panels 14, and yet are not so long as to cause the end panels to snap up out of the desired position to leave the end bottles uncovered. If the fold lines 58 were very long, extending all the way to the lowermost edge of the end panels, for example, the memory of the fibers of the paperboard in the fold lines would cumulatively be enough of a force to overcome the forces tending to hold the gusset panels folded down about the fold lines 56. The point at which the fold lines 58 should terminate can obviously vary depending on the dimensions of the carrier and the thickness of the paperboard. This can best be determined by trying various dimensions until the optimum location is reached. In general, however, by keeping the fold lines 58 fairly short so that they terminate at about the same general area as the end panels themselves terminate in the prior art arrangements which incorporate very short end panels of the type disclosed in the Kipp and Manizza patents referred to above, the forces developed by fiber memory are not sufficient to cause the fold lines 58 to unfold and allow the end panels to spring up out of place. In practice it is preferred that the end panels be at least as long as one-half the height of the carrier and that the fold lines 58 be not more than about half the length of the end panels. As an example, in a carrier adapted to hold four twelve-ounce beverage bottles and formed of paperboard having a caliper of 20 points, the loaded carrier was approximately 6 inches in height, the fold lines 58 were about 1½ inches long and the end panels were approximately 3½ inches long.

A number of modifications may be made to the carrier of the present invention if desired. For example, tear strips can be provided to facilitate removal of the bottles. In addition, score lines can be provided in the side panels to cause the side panels to conform more readily to the sloped shape of the bottles between the caps and the barrel portion of the bottles, although the side panels will normally conform to the bottle outline even without such fold lines if properly dimensioned. Although it is preferred to space the bottom of the gusset panels as shown in the drawings, a simple slit connected to the end of the fold lines 58 will suffice to define the bottom end of a gusset panel.

It will be appreciated that the invention provides for an end panel of sufficient length to supply the various benefits discussed above while at the same time allowing the carrier to be formed from a blank of economical size. The formation of the end panel structure in the packaging process is exceedingly simple, requiring only a single folding step to fold and lock the end panel in place, thus avoiding the need for complicated machinery and attendant maintenance problems.

It should now be obvious that although a preferred embodiment of the invention has been described, changes to specific details of the embodiment may be made without departing from the spirit and scope of the invention as defined in the appended claims.

What is claimed is:

1. In a paperboard wrap-around article carrier including a top panel having side edges and end edges, side panels having upper edges and end edges, the upper edges of the side panels being connected to the side edges of the top panel by fold lines, and a bottom panel connecting the side panels, the improvement comprising:

end panels connected by fold lines to the end edges of the top panel, each end panel having an unconnected bottom edge and unconnected side edge portions adjacent the unconnected bottom edge;

gusset panels connecting the end panels to the side panels;

each gusset panel being connected by a first fold line to a portion of the associated side panel near the fold line connecting the side panel to the top panel;

each gusset panel being connected by a second fold line to a portion of the associated end panel near the fold line connecting the end panel to the top panel;

the second fold lines terminating in lowermost ends spaced a substantial distance from the bottom edge of the associated end panel; and each gusset panel further having a lower edge extending outwardly from the lowermost end of the associated second fold line to the adjacent end edge of the associated side panel;

the second fold lines connecting the gusset panels to an end panel being spaced apart a distance less than the distance between the unconnected side edge portions of the end panel.

2. In a paperboard wrap-around article carrier according to claim 1, wherein the distance between the unconnected edge portions of an end panel is substantially equal to the distance between the adjacent side panels.

3. In a paperboard wrap-around article carrier according to claim 1, wherein the second fold lines lie in a generally vertical plane taken through the fold lines connecting the side panels to the top panel.

4. In a paperboard wrap-around article carrier according to claim 1, wherein the force developed by the cumulative memory of the paperboard along the second fold lines connecting the gusset panels to the end panels is insufficient to pivot the end panels up about the fold lines connecting the end panels to the top panel, and wherein the length of the end panels is at least as great as one-half the height of the carrier and the length of the second fold lines is less than one-half the length of the end panels.

5. A paperboard production blank for forming a wrap-around article carrier, comprising:

a top panel section having end edges and side edges;

side panel sections connected by fold lines to the side edges of the top panel section and to bottom panel sections, the side panel sections having end edges;

the distance between the end edges of the top panel section being less than the distance between the end edges of the side panel sections;

end panels connected by fold lines to the end edges of the top panel section, the end panels having an unconnected bottom edge and unconnected side edge portions adjacent the unconnected bottom edge;

gusset panels connecting the end panels to the side panel sections;

each gusset panel being connected by a first fold line to the adjacent side panel section;

each gusset panel being connected by a second fold line to the adjacent end panel, the second fold lines extending substantially parallel to the side edges of the end panels;

each first fold line forming an acute angle with the adjacent second fold line;

the second fold lines terminating at a point located a substantial distance from the bottom edge of the end panels; and each gusset panel further having an edge extending from the termination point of the associated second fold line to the adjacent end edge of the associated side panel;

the distance between the second fold lines connecting the gusset panels to an end panel being less than the distance between the unconnected side edge portions of the end panel.

6. A paperboard production blank according to claim 5, wherein the second fold lines are aligned with the fold lines connecting the top panel section to the side panel sections.

7. A paperboard production blank according to claim 6, wherein the fold lines connecting the top panel section to the end panels, the fold lines connecting the top panel section to the side panel sections, and the first and second fold lines of each gusset panel meet at common points.

8. A paperboard production blank according to claim 5, wherein the distance between the bottom edge of an end panel and the fold line connecting the end panel to the top panel section is greater than half the distance between the fold lines connecting the side panel sections to the top panel section and to the bottom panel sections.

9. A paperboard production blank according to claim 8, wherein the length of the second fold lines is no more than half the distance between the bottom edge of the associated end panel and the fold line connecting the end panel to the top panel section.

* * * * *